United States Patent [19]

Watkins

[11] 4,200,312

[45] Apr. 29, 1980

[54] SUBSEA FLOWLINE CONNECTOR

[75] Inventor: Bruce J. Watkins, Palos Verdes Estates, Calif.

[73] Assignee: Regan Offshore International, Inc., San Pedro, Calif.

[21] Appl. No.: 875,639

[22] Filed: Feb. 6, 1978

[51] Int. Cl.[2] ..... F16L 37/08

[52] U.S. Cl. ..... 285/18; 285/96; 285/137 A; 285/316; 285/DIG. 21; 137/798

[58] Field of Search ..... 285/18, 137 A, DIG. 21, 285/316, 277

[56] References Cited

U.S. PATENT DOCUMENTS

| | | | |
|---|---|---|---|
| 3,201,147 | 8/1965 | De Cenzo | 285/277 X |
| 3,222,088 | 12/1965 | Haeber | 285/18 |
| 3,333,870 | 8/1967 | Watkins | 285/18 |
| 3,347,567 | 10/1967 | Watkins | 285/24 |
| 3,360,048 | 12/1967 | Watkins | 166/87 |
| 3,452,815 | 7/1969 | Watkins | 166/0.5 |
| 3,485,051 | 12/1969 | Watkins | 61/46.5 |
| 3,489,215 | 1/1970 | Regan | 166/87 |
| 3,492,027 | 1/1970 | Herring | 285/18 |
| 3,493,043 | 2/1970 | Watkins | 166/0.5 |
| 3,613,726 | 10/1971 | Torres | 285/316 X |
| 3,675,713 | 7/1972 | Watkins | 285/18 X |
| 3,779,313 | 12/1973 | Regan | 166/0.6 |

*Primary Examiner*—Thomas F. Callaghan
*Attorney, Agent, or Firm*—Poms, Smith, Lande & Rose

[57] ABSTRACT

A connector for subsea flowlines is disclosed having a metal-to-metal seal affording minimum flexure of the flowline. Each end of the flowline to be connected is provided with a mandrel. One mandrel, designated the flowline mandrel, is provided with a seating surface and an external locking surface. The second mandrel, designated the connector mandrel, is provided with a seating surface adapted for mating relationship with the seating surface of the flowline mandrel with a metal seal disposed therebetween. Additionally, the connector mandrel carries a first sleeve disposed concentrically about it adapted to slide over the end of the connector mandrel into circumferential engagement with the flowline mandrel. A plurality of locking dogs are carried by the first sleeve adapted for engagement with the external locking surface of the flowline mandrel. A second sleeve is disposed concentrically about the first sleeve with an interior inclined surface adapted to force the dogs into locking engagement with the exterior locking surface of the flowline mandrel as the second sleeve is moved longitudinally. The sleeves are provided with seals therebetween and ports into the confined areas thus defined to allow the sleeves to be moved as pistons longitudinally between extended and retracted positions whereby the connector can be connected and locked as well as unlocked and disconnected from a remote location. Additionally, an auxiliary connector is carried with the flowline connector elements whereby a power or control signal connected therethrough only has continuity when the flowline connector is connected and locked.

6 Claims, 9 Drawing Figures

SUBSEA FLOWLINE CONNECTOR

BACKGROUND OF THE INVENTION

The present invention relates to conduit connectors and more particularly to connectors employed with flowlines and the like employed in undersea drilling and pumping operations.

Undersea drilling operations afford a unique environment requiring specially adapted equipment. In normal surface drilling operations, the wellhead from whence the drilling operation proceeds into the earth's surface is easily accessible to the operating personnel. By contrast, in undersea drilling operations the operating personnel are located in a floating platform or vessel on the ocean's surface with the wellhead disposed on the ocean floor many feet below. To communicate with the wellhead, guidelines are provided between the wellhead and the floating platform. The various conduits for flow between the surface and the wellhead are guided into position along the aforementioned guidelines. The connectors employed in such flow conduits, must, therefore, be connectable and disconnectable from the floating platform on the ocean's surface.

The main riser is the primary conduit of the system. Accordingly, its placement is of primary concern. The main conduit connector passes through the "Christmas tree" which forms the principle valving structure of the assembly. Disposed about the main riser connector are a plurality of smaller connectors for the smaller conduits or flowlines of the system. These auxiliary flowlines must be adapted for connection on a secondary basis. That is, the main riser conduit connector is typically seated and connected first followed by alignment and connection of the auxiliary connectors.

To allow for such secondary connection, it has been typical in such apparatus to provide the flowline connectors with a fairly loose fit to provide alignment and to then seal the connection therebetween when the two portions of the connector are slipped into concentric engagement by a deformable seal activated by fluid pressure provided by an auxiliary line from the surface. For example, an annular rubber bladder can be disposed to be positioned between the outer portion of the connector and the inner portion of the connector. When filled with fluid, such a bladder expands to fill the space therebetween to provide a leak-proof seal. While being leak-proof, such a deformable material employed as the primary seal has numerous drawbacks. First of all, the connection is not rigid. Thus, as the flowline is moved about by the ocean currents the flexing forces imposed therein are transmitted to the connector as the weakest point in the line. Moreover, such deformable material is prone to leak producing gouging and the like as a function of the mating process with the metallic components of the connector. The damage problem to the internal components of the connector is also augmented by the nature of the connector itself. Being typically a pair of concentrically interlocking conduit elements, engagement must be begun while the main riser connector is being maneuvered into position. That is, when the main riser connector has been completely seated and locked, the auxiliary connectors for the flowlines must have been concentrically engaged in the process and be ready for sealing.

Another drawback of prior art flowline connectors employed in subsea drilling operations is the total reliance on a surface controlled signal for the activation of the subsea in-line valves provided in the flowlines. That is, each of the flowlines is typically provided with an in-line valve at the wellhead. As the flowline is connected, a control line carried in combination therewith is simultaneously connected. Upon activation of a control signal through the control line, the in-line valve is opened to allow flow of fluid from the wellhead through the flowline. Once the surface signal opens the valve, the fluid will flow into the flowline regardless of the successful connection of the flowline connector. It would be desirable to have the flowline connection and the control signal to the in-line flow valve in interactive combination whereby in the event of an incomplete flowline connection, the control signal from the surface would be unable to open the in-line valve.

Wherefore, it is the objective of the present invention to provide a flowline connector for subsea operations which is provided with a metal-to-metal connection providing rigidity of the connector wherein the connector can be left in total disengagement until the main flowline connector has been positioned and locked guaranteeing positional alignment of the flowline connector and wherein the control line providing the signal to the in-line valve associated with the flowline being connected has continuity established therethrough only in the event of complete connection and locking of the flowline connector.

SUMMARY

The foregoing objectives have been met in the present invention which provides a connector for connecting a movable flowline to a fixed flowline comprising a flowline mandrel conduit connected on one end to the fixed flowline having a mating surface and an external locking surface on the other end; a connector mandrel conduit connected on one end to the moving flowline having a mating surface on the other end adapted to sealably mate with the mating surface of the flowline mandrel conduit when the flowline and connector mandrel conduits are disposed in end-to-end relationship along a common longitudinal axis; a first sleeve disposed concentrically about the connector mandrel being longitudinally movable between an extended position extended beyond the mating surface of the connector mandrel and a retracted position, the first sleeve being shaped to fit concentrically about the flowline mandrel conduit in the extended position; locking means carried by the first sleeve for engaging the locking surface being movable between a locked position engaged with the locking surface and an unlocked position disengaged from the locking surface, the locking means being disposed to engage the locking surface only when the mating surfaces are mated and the first sleeve is in the extended position; a second sleeve disposed concentrically about the portion of the first sleeve carrying the locking means and having an actuating surface for engaging the locking means, the second sleeve being movable between a first position where the locking means is moved to and held in the locked position and a second position where the locking means is free to move from the locked positioned to the unlocked position; a third sleeve disposed concentrically about the first sleeve so as to allow the first sleeve to slide longitudinally within the third sleeve; and, means for holding the third sleeve with the connector mandrel conduit disposed in face-to-face relationship along the common axis with the flowline mandrel conduit whereby the movement of the movable flowline is limited to longitudinal movement along the common axis between a position of mating of the mating surfaces and a position of spaced relationship between the mating surfaces. In the preferred embodiment as shown, the first and second sleeves are moved hydraulically from the surface by fluid control lines connected to ports provided in the sleeves and seals disposed between the sleeves to cause the sleeves to act as hydraulic pistons. Additionally, a separable control line connector is provided having an inlet portion including an inlet and an outlet portion including an outlet, the inlet being adapted for connection to a control line providing a control signal such as to the in-line control valve, the outlet being adapted for connection to a device responsive to the control signal such as the in-line control valve, one of the control line connector portions being carried by the flowline mandrel, the other of the control line connector portions being carried by the second sleeve to move in combination therewith and being positioned to establish continuity between the inlet and the outlet only when the locking means is in locked engagement with the locking surface.

DESCRIPTION OF THE PREFERRED EMBODIMENT

Figure 1A:
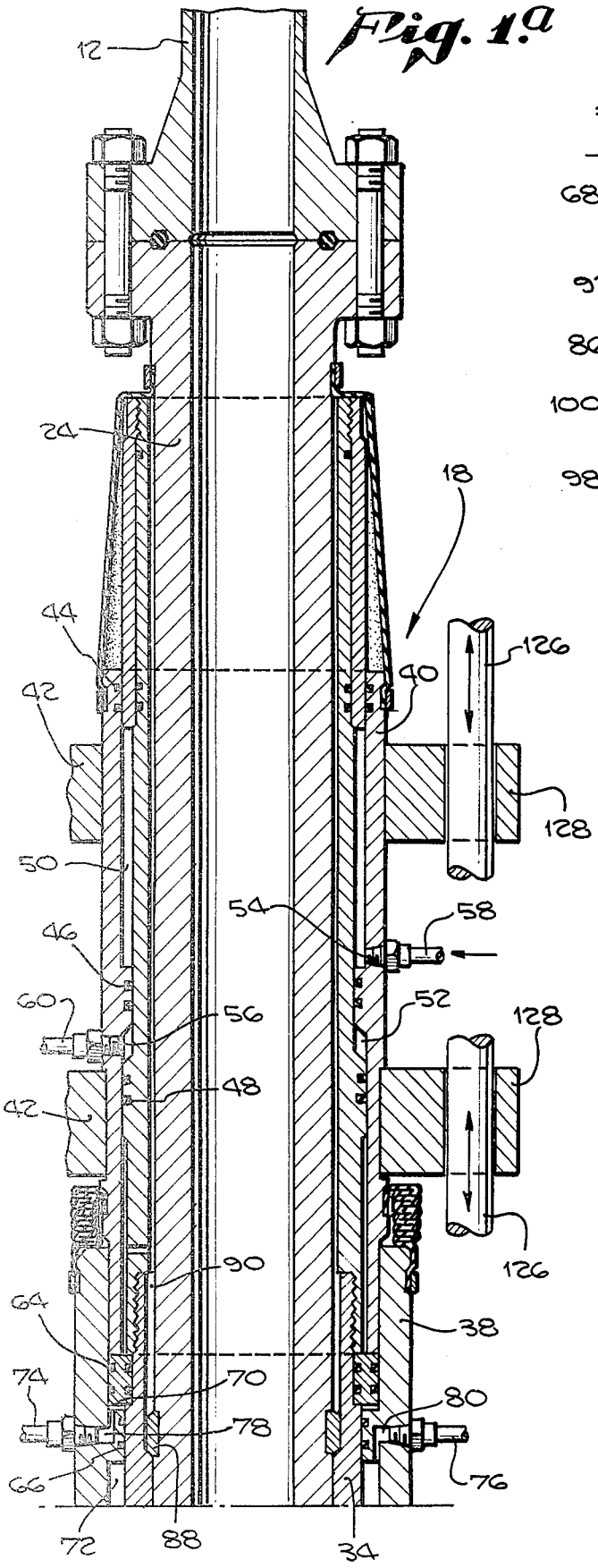
FIG. 1 is a cut-away elevation through the connector of the present invention with the elements thereof in their fully retracted position.
Figure 1B:
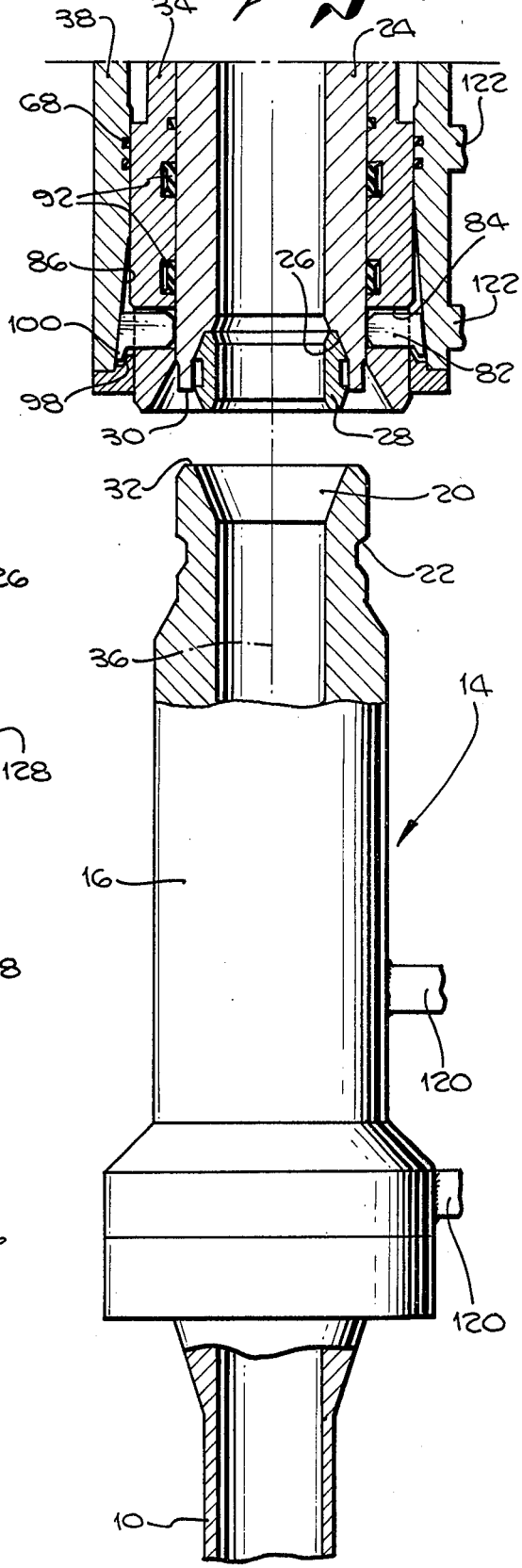

Referring first to FIG. 1, a fixed flowline 10 and a movable flowline 12 are shown in preparation for connection by the connector of the present invention generally indicated as 14. Connector 14 comprises a flowline mandrel 16 and a connector assembly indicated generally as 18. Flowline mandrel 16 is a cylindrical conduit adapted on one end to be connected to the fixed flowline 10 and having a seating surface 20 on the interior of the other end. Additionally, a locking surface is provided on the exterior of the end containing the seating surface 20 in the form of groove 22. The shape of groove 22 will be described in greater detail hereinafter.

Connector assembly 18 has a connector mandrel 24 as the inner portion thereof. Connector mandrel 24 is also a cylindrical conduit adapted at one end for connection to movable flowline 12 and with a seating surface 26 on the opposite end thereof. A metal seal 28 is carried by connector mandrel 24. Metal seal 28 is adapted to sealably mate with both seating surfaces 20 and 26. Additionally, mandrels 16 and 24 are provided with abutting mating surfaces 30 and 32 respectively which are adapted to be in abutting mating relationship when metal seal 28 is in mating relationship with seating surfaces 20 and 26. The manner in which metal seal 28 mates with seating surfaces 20 and 26 as well as the abutting mating relationship between surfaces 30 and 32 can best be seen in the detailed enlarged drawing of FIG. 4.

A first sleeve 34 is disposed concentrically about connector mandrel 24. First sleeve 34 is adapted to slide longitudinally along connector mandrel 24. With flowline mandrel 16 and connector mandrel 24 disposed concentrically along a common longitudinal axis 36, first sleeve 34 and the end of flowline mandrel 16 having groove 22 therein are sized such that first sleeve 34 can slide over flowline mandrel 16 concentrically therewith. A second sleeve 38 is disposed in sliding concentric relationship about the end of first sleeve 34 adjacent seating surface 26. A third sleeve 40 is also disposed in concentric sliding relationship with first sleeve 34 between second sleeve 38 and the connection to movable flowline 12. Third sleeve 40 is carried by a pair of brackets 42. In the preferred embodiment, brackets 42 are connected on the opposite end to the Christmas tree structure. Thus, assuming that the Christmas tree is positioned with the main riser connector engaged and locked, brackets 42 hold connector assembly 18 and movable flowline 12 in position with the common longitudinal axis 36 in coincidence as shown in FIG. 1 whereby movable flowline 12 and connector mandrel 24 in combination therewith are movable only longitudinally along common axis 36. As can be seen, this arrangement meets one of the stated objectives of having the main riser connector fully connectable without contact between the engaging elements of the flowline connector. As can be seen, as positioned in FIG. 1 connector assembly 18 has not contacted any part of the flowline mandrel 16 and, in fact, is in spaced end-to-end relationship therewith.

Figure 2:
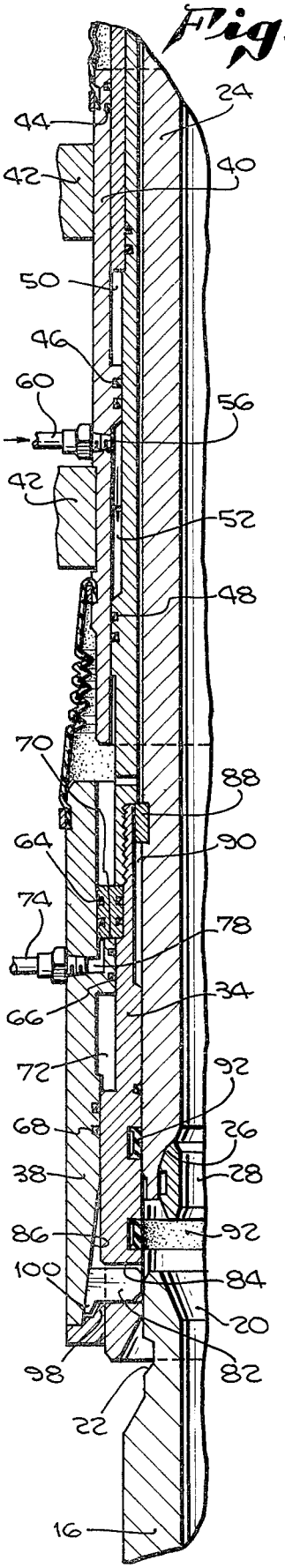
FIG. 2 is a partially cut-away elevation of the present invention showing the first sleeve in a partially extended position in beginning engagement with the flowline mandrel.
Figure 3:
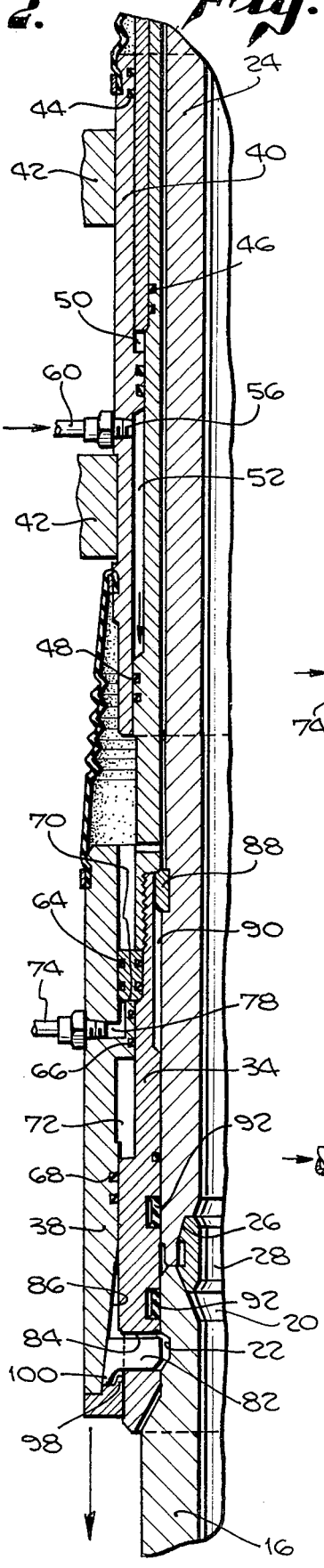
FIG. 3 is a partial cut-away elevation of the present invention showing the two mandrels in mating relationship with the first sleeve fully engaged with the flowline mandrel in an unlocked position.

The space between first sleeve 34 and third sleeve 40 is provided with three circumferential seals 44, 46 and 48. Each of the seals 44, 46 and 48 is carried by one of the sleeves 34, 40 and is in sliding sealed engagement with the other cylinder whereby two piston chambers 50 and 52 are formed. A port 54 is provided into piston chamber 50 and a port 56 is provided into piston chamber 52. The ports 54 and 56 are adapted for connection to control lines 58 and 60 respectively which connect to the surface vessel on the opposite end. It can be seen that by applying a source of fluid under pressure to control line 60, the pressurized fluid will be forced through port 56 into piston chamber 52 to cause first sleeve 34 to extend from the position of FIG. 1 to the partially extended position of FIG. 2 and thence to the fully extended position of FIG. 3. With first sleeve 34 in its fully extended position, movable flowline 12 and connector mandrel 24 can be moved safely longitudinally toward flowline mandrel 16 until surfaces 30 and 32 are in abutment and metal seal 28 is seated on seating surfaces 20 and 26 as shown in FIG. 3. In FIG. 3, connector 14 is shown in such a connected and unlocked position.

Figure 4:
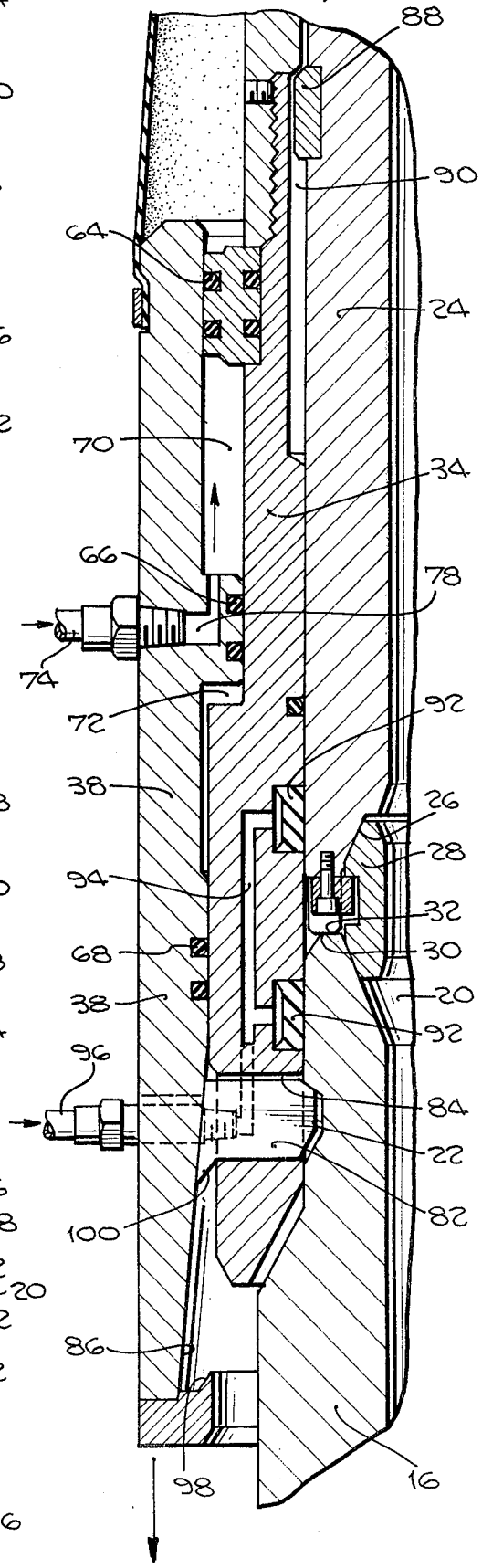
FIG. 4 is a more detailed partially cut-away view through the apparatus of the present invention adjacent the locking portion showing the locking dogs in locked engagement.
Figure 5A:
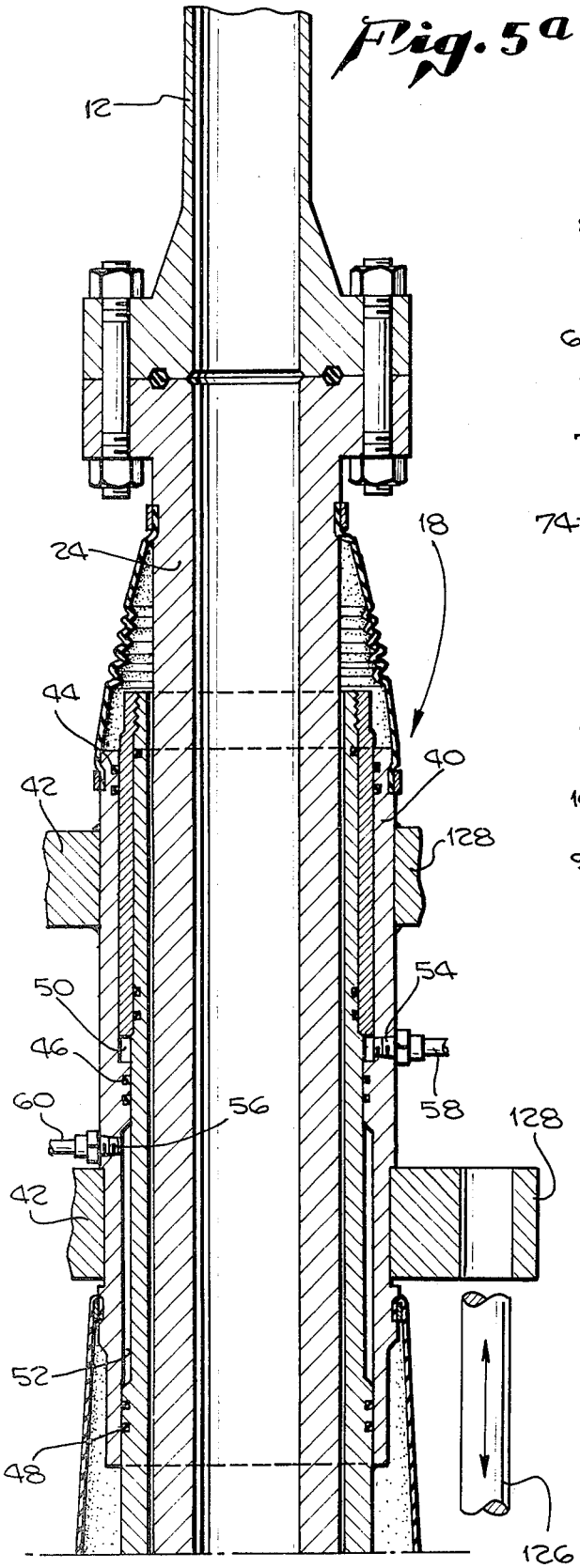
FIG. 5 is a cut-away elevation of the present invention in its fully engaged and locked position.
Figure 5B:
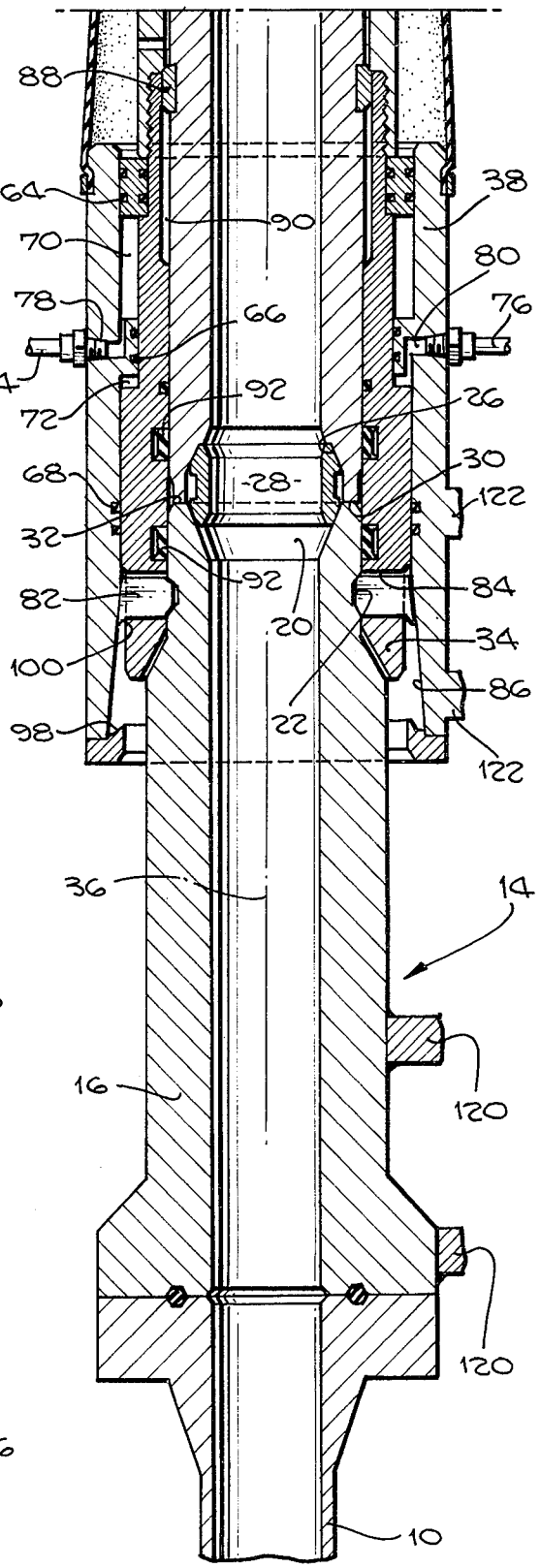

In like manner to first and third sleeves 34 and 40, first and second sleeves 34 and 38 are provided with seals 64, 66 and 68 therebetween so as to form piston chambers 70 and 72 to which control lines 74 and 76 can be connected through ports 78 and 80 respectively. Thus, by applying a fluid under pressure to control lines 74, pressure is created within piston chamber 70 so as to extend second sleeve 38 from its retracted or unlocked position to its extended or locked position as shown in FIGS. 4 and 5.

As can be seen, the foregoing extension actions of sleeves 34 and 38 can be reversed by applying pressure to piston chambers 50 and 72 respectively. That is, by pressurizing piston chamber 52 by the application of fluid pressure to control line 58, first sleeve 34 is retracted to its retracted position of FIG. 1. Likewise, by the application of fluid pressure to control lines 76 so as to pressurize piston chamber 72, second sleeve 38 is retracted to its unlocked position of FIG. 1.

A plurality of dogs 82 are disposed in holes 84 of first sleeve 34 radially equally spaced about the end thereof adjacent seating surface 26. Second sleeve 38 has an inclined activating surface 86 adjacent the end thereof. Activating surface 86 is so angled such that with second sleeve 38 in its retracted or "unlocked" position as shown in FIG. 1, dogs 84 are free to slide along the exterior surface of both connector mandrel 24 and flowline mandrel 16. With first sleeve 34 in its extended position as shown in FIGS. 3, 4 and 5, activating surface 86 is angled such that when second sleeve 38 is extended to its extended or "locked" position as shown in FIGS. 4 and 5, dogs 82 are forced radially inward in a plane normal to longitudinal axis 36 to engage groove 22 to thereby lock connector assembly 18 to flowline mandrel 16.

As will further be noted, connector mandrel 24 is provided with a stop 88 on the exterior surface thereof which rides in a slot 90 on the inner surface of first sleeve 34. Thus, as first sleeve 34 is extended, stop 88 ultimately contacts the upper surface of slot 90 to prevent extension of first sleeve 34 beyond its intended extended position. In combination with this, dogs 82 are wedge-shaped in relation to the surface of groove 22 closest to the mating surfaces of mandrels 16 and 24. Thus, as dogs 82 are driven radially into groove 22 by activating surface 86, a compressive force is created on mating surfaces 30 and 32 by stop 88 in contact with the top of slot 90 acting against the wedging force of dogs 82 attempting to seat in groove 22.

When completely connected and locked, the connector 14 of the present invention appears as shown in FIG. 5. As can be seen, a metal-to-metal seal exists and the two mandrels 16 and 24 are in metal-to-metal abutted end-to-end contact as well. Such an arrangement provides for maximum possible rigidity of the connection of the flowlines 10 and 12 as desired.

To provide additional fluid sealing capability, expandable seals 92 are provided within first sleeve 34 disposed to be adjacent mandrels 16 and 24 respectively when connector 14 is in its connected and locked position as shown in FIGS. 4 and 5. With particular reference to FIG. 4, it can be seen that the area behind expandable seals 92 is connected to a manifold 94 connected to a control line 96 through which fluid pressure can be applied to expand seals 92 so as to make a completely fluid leak-proof seal at the junction between mandrels 16 and 24.

Additionally, it will be noted that second sleeve 38 is provided with a second activating surface 98 adapted to grip the back of dogs 82 at the area indicated as 100 so as to retract and hold dogs 82 in a retracted position as second sleeve 38 is retracted to its unlocked position.

Figure 6:
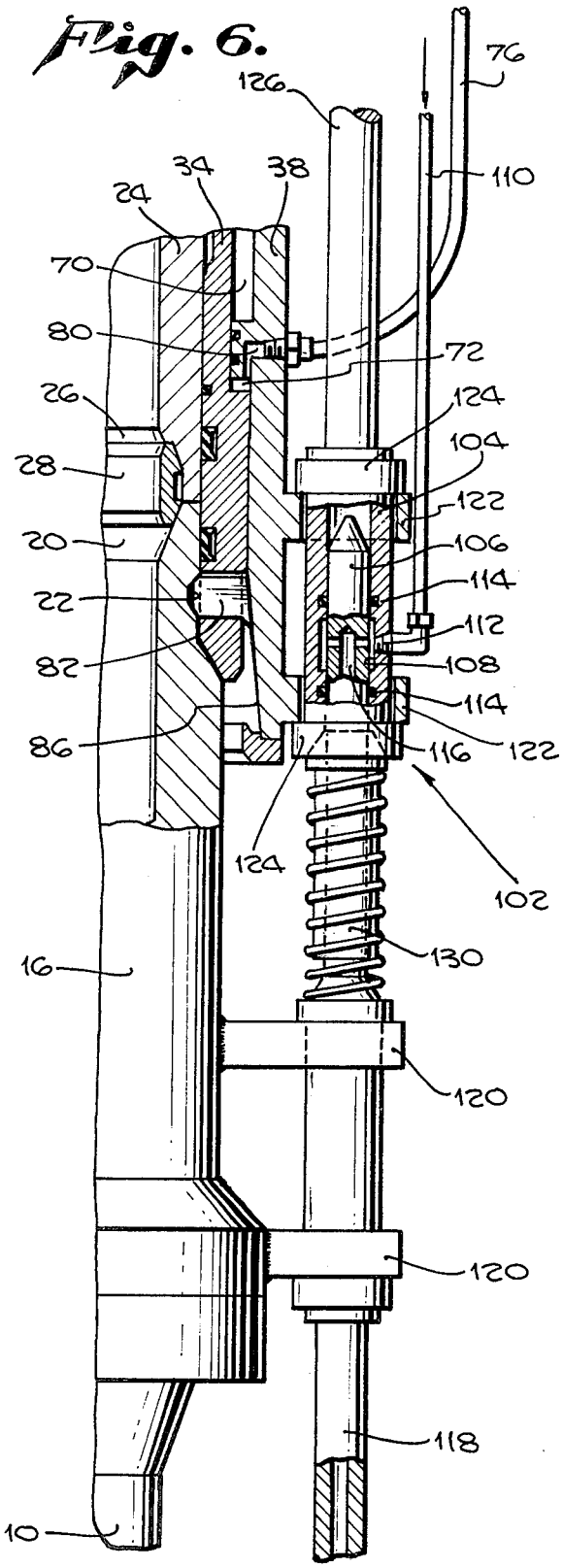
FIG. 6 is a partially cut-away elevation of the control connector carried by the flowline connector of the present invention in its engaged position.
Figure 7:
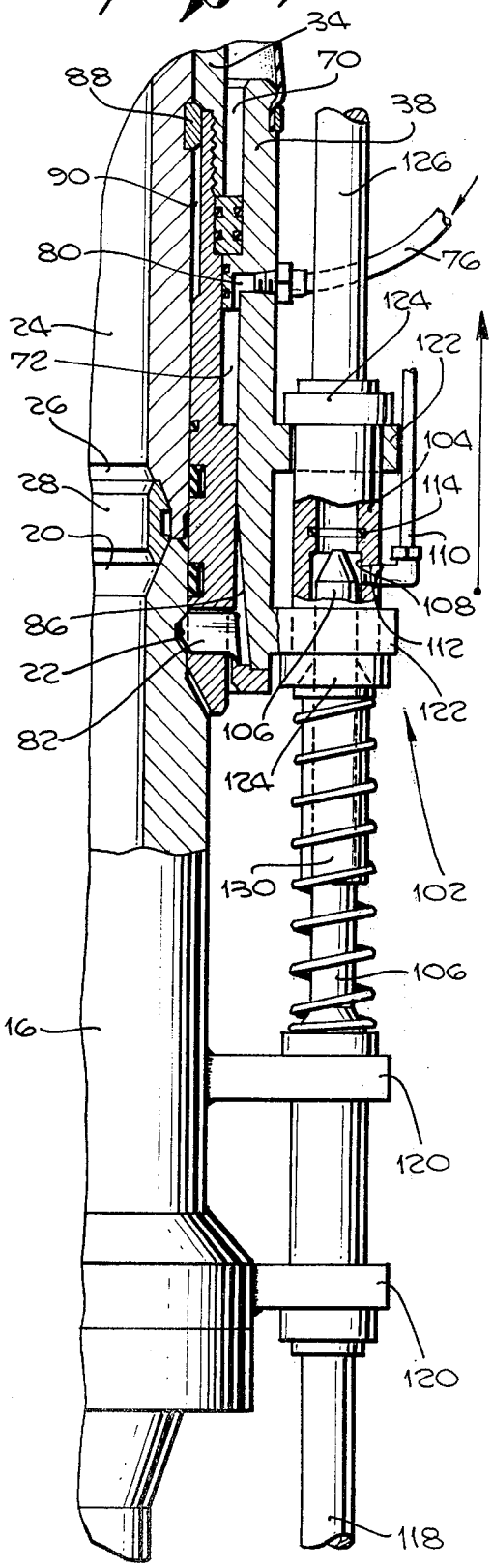
FIG. 7 is a partially cut-away elevation of the apparatus of FIG. 6 shown in its disengaged position.

Turning now to FIGS. 6 and 7, the auxiliary control line connector of the present invention particularly suited for opening an in-line valve disposed within the fixed flowline 10 is shown generally indicated as 102. Control line connector 102 is of the "stab connector" type. Connector 102 comprises a female member 104 and a male member 106 adapted for insertion into female member 104. Female member 104 is provided with an internal groove 108 adapted to communicate with a control line 110 through port 112. Internal groove 108 forms a manifold disposed about the inner surface of female member 104 between a pair of seals 114 when members 104 and 106 are mated as shown in FIG. 6. Male member 106 is provided with a passageway communicating from the exterior of male member 106 adjacent the internal manifold thus created when male member 106 is operably inserted into female member 104 and extending through the length of male member 106 to connect with an output line 116 which is connected to the in-line valve or the like (not shown). Because of the nature of a stab connector such as that shown for connector 102, continuity between control lines 110 and 118 exists only when male member 106 is fully inserted into female member 104 such that internal passageway 116 is in communication with internal groove 108. To achieve the desired objective of having control line 110 connected to output line 118 only when connector 102 is fully connected and locked, male member 106 is carried by brackets 120 rigidly connected to flowline mandrel 16 along a line in parallel spaced relationship to axis 36. At the same time, female member 104 is carried in facing concentric relationship to male member 104 by a pair of brackets 122 rigidly connected to second sleeve 38 to move in direct combination therewith. Brackets 120 and 122 are disposed such that male member 106 and female member 104 are in operable engagement only when second sleeve 38 is extended to a position where dogs 82 are lockingly engaged with groove 22. This configuration is shown in FIG. 6. At any time that second sleeve 38 is retracted from the locked position as shown in FIG. 7, female member 104 is withdrawn from operable engagement with male member 106.

To improve the operability of the foregoing control line connector 102, it is preferred that female member 104 be suspended in brackets 122 by a clearance fit between two collars 124 and be rigidly connected on the upper end to a support rod 126 adapted to slidably engage a pair of guide brackets 128 carried by third sleeve 40. In this manner, female member 104 is free to move laterally a limited amount to accommodate minor disalignments between female member 104 and male member 106. At the same time, guide rod 126 attached therethrough sliding through guide brackets 128 prevents any rotation of the longitudinal axis of female member 104 away from the common longitudinal axis shared with male member 106. Additionally, it is desirable to fit male member 106 with a biased protective sleeve 130 as shown. Biased protective sleeve 130 is adapted to extend over male member 106 to protect the openings to passageway 116 when male member 106 is withdrawn from female member 104 and to be pushed back along male member 106 by female member 104 to allow insertion of male member 106 during connection of the two.

Thus from the foregoing description it will be apparent that the present invention has met its desired objectives of providing a subsea flowline connector which provides a rigid metal-to-metal connection and interlocking control of the control line connection to the in-line valve controlling fluid flow to the flowline whereby the in-line valve can only be opened when the flowline connector is connected and locked.

While the present invention is primarily directed to providing a remotely operable connector for subsea flowlines, it will be apparent that its use in other conduit connection applications may be helpful in providing superior performance where the particular benefits attendant thereto are applicable.

Having thus described my invention, I claim:

1. A remotely actuatable connector for releasably connecting a pair of pipes comprising:

(a) a first mandrel conduit adapted on one end for connection to one of the pipes and having a seating surface and an external locking surface on the other end;

(b) a second mandrel conduit adapted on one end for connection to the other of the pipes and having a seating surface on the other end adapted to sealably mate with said seating surface of said first mandrel conduit when said first and second mandrel conduits are disposed in end-to-end relationship along a common longitudinal axis;

(c) a first sleeve disposed concentrically about said second mandrel and including movable locking means adapted for movement between a locked position engaged with said locking surface and an unlocked position disengaged from said locking surface, said first sleeve being movable longitudinally between an extended position wherein a portion of said first sleeve is extended beyond the end of said second mandrel conduit and a retracted position wherein said first sleeve is retracted over said second mandrel conduit from said extended position, said first sleeve being shaped such that when in said extended position said first sleeve will fit concentrically about said first mandrel conduit with said locking means in position for engagement with said locking surface and with said seating surfaces mated;

(d) means adapted for connection to a remote supply of selectable actuating power for moving said first sleeve between said extended and retracted positions;

(e) a second sleeve disposed concentrically about said first sleeve and having an actuating surface for engaging said locking means of said first sleeve, said second sleeve being movable between a first position where said locking means is moved to and held in its locked position and a second position where said locking means is free to move from its locked position to its unlocked position; and, (f) means adapted for connection to a remote supply of actuating power for moving said second sleeve between said first and second positions; and wherein, (g) said first sleeve and said second mandrel conduit have cooperating stop means for preventing said first sleeve from extending over the end of said second mandrel conduit beyond said extended position; and, (h) said locking means and said locking surface engage in cammed relationship whereby as said actuating surface of said second sleeve moves said locking means into said locked position said mated seating surfaces are drawn tightly together by compressive force on said stop means and said locking surface.

2. The remotely actuatable pipe connector claimed in claim 1 wherein:

said second sleeve includes a second actuating surface for moving said locking means from its locked position to its unlocked position and holding it there.

3. A connector for connecting a movable flowline to a fixed flowline comprising:

(a) a flowline mandrel conduit connected on one end to the fixed flowline having a mating surface and an external locking surface on the other end;

(b) a connector mandrel conduit connected on one end to the moving flowline having a mating surface on the other end adapted to sealably mate with said mating surface of said flowline mandrel conduit when said flowline and connector mandrel conduits are disposed in end-to-end relationship along a common longitudinal axis;

(c) a first sleeve disposed concentrically about said connector mandrel being longitudinally movable between an extended position extended beyond said mating surface of said connector mandrel and a retracted position retracted along said connector mandrel from said extended position, said first sleeve being shaped to fit concentrically about said flowline mandrel conduit in said extended position;

(d) locking means carried by said first sleeve for engaging said locking surface being movable between a locked position engaged with said locking surface and an unlocked position disengaged from said locking surface, said locking means being disposed to engage said locking surface only when said mating surfaces are mated and said first sleeve is in said extended position;

(e) a second sleeve disposed concentrically about the portion of said first sleeve carrying said locking means and having an actuating surface for engaging said locking means, said second sleeve being movable between a first position where said locking means is moved to and held in said locked position and a second position where said locking means is free to move from said locked position to said unlocked position;

(f) a third sleeve disposed concentrically about said first sleeve so as to allow said first sleeve to slide longitudinally within said third sleeve; and, (g) means for holding said third sleeve with said connector mandrel conduit disposed in face-to-face relationship along the common axis with said flowline mandrel conduit whereby the movement of the movable flowline is limited to longitudinal movement along said common axis between a position of mating of said mating surfaces and a position of spaced relationship between said mating surfaces; and wherein, (h) said locking surface is a circumferential groove in said flowline mandrel conduit;

(i) said locking means comprises a plurality of circumferentially spaced dogs adapted for radial movement in a plane normal to the longitudinal axis of said flowline mandrel conduit into and out of said groove;

(j) said connector mandrel conduit includes stop means for preventing extension of said first sleeve past said extended position; and, (k) said dogs are wedge-shaped on the side facing said mating surfaces whereby as said dogs are pushed radially into said groove to said locked position said wedge shape will engage the sidewall of said groove adjacent said mating surfaces and create a compressive force in combination with said stop means compressing said mating surfaces together.

4. The flowline connector claimed in claim 3 and additionally comprising:

(a) three seals disposed circumferentially in longitudinally spaced relationship between the external surface of said first sleeve and the internal surface of said third sleeve, each of said seals being attached to one of said sleeves and in sealed longitudinal sliding engagement with the other of said sleeves whereby a first and second piston chamber are formed;

(b) said third sleeve including a first port adapted for connection to a source of fluid under pressure and communicating with said first piston chamber; and, (c) said third sleeve including a second port adapted for connection to a source of fluid under pressure and communicating with said second piston chamber whereby said first sleeve can be moved between said extended and retracted positions by selectively applying fluid pressure to said first and second ports 5. The flowline connector claimed in claim 3 and additionally comprising:

(a) three seals disposed circumferentially in longitudinally spaced relationship between the external surface of said first sleeve and the internal surface of said second sleeve, each of said seals being attached to one of said sleeves and in sealed longitudinal sliding engagement with the other of said sleeves whereby a third and fourth piston chamber are formed;

(b) said second sleeve including a third port adapted for connection to a source of fluid under pressure and communicating with said third piston chamber; and, (c) said second sleeve including a fourth port adapted for connection to a source of fluid under pressure and communicating with said fourth piston chamber whereby said second sleave can be moved longitudinally between said locked and unlocked positions by selectively applying fluid pressure to said third and fourth ports.

6. The flowline connector claimed in claim 3 wherein:

said second sleeve includes a second actuating surface for moving said locking means from its locked position to its unlocked position and holding it there.

* * * * *